US005341761A

United States Patent [19]

O'Brien et al.

[11] Patent Number: 5,341,761

[45] Date of Patent: Aug. 30, 1994

[54] EVACUATION SYSTEM

[76] Inventors: Daniel P. O'Brien; Paul Johnson, both of 95 Elizabeth Avenue, St. John's Newfoundland, Canada

[21] Appl. No.: 71,249

[22] Filed: Jun. 4, 1993

[51] Int. Cl.[5] ..... B63B 23/04

[52] U.S. Cl. ..... 114/365; 114/371; 114/373

[58] Field of Search ..... 114/365, 366, 367, 368, 114/369, 370, 371, 372, 373, 377, 378; 182/10, 12, 47, 48; 405/1, 3, 4

[56] References Cited

U.S. PATENT DOCUMENTS

| | | | |
|---|---|---|---|
| 389,410 | 9/1888 | Rodin | 114/377 |
| 426,449 | 4/1890 | Hosford . | |
| 582,069 | 5/1897 | Leslie . | |
| 609,532 | 8/1898 | Cappellini . | |
| 800,842 | 10/1905 | Burt . | |
| 1,116,761 | 11/1914 | Thompson . | |
| 1,265,771 | 5/1918 | Grohmann . | |
| 1,562,583 | 11/1925 | Pease . | |
| 1,827,534 | 10/1931 | McKenzie . | |
| 2,091,327 | 8/1937 | McPartland . | |
| 2,398,274 | 9/1946 | Albert . | |
| 2,618,792 | 11/1952 | Vreugdenhil | 114/377 |
| 2,708,346 | 5/1955 | Smith | 114/365 |
| 3,880,254 | 4/1975 | Fitzgerald et al. . | |
| 4,522,144 | 6/1985 | Klem . | |
| 4,739,721 | 4/1988 | Peyre | 114/365 |
| 4,781,144 | 11/1988 | O'Brien | 114/365 |

FOREIGN PATENT DOCUMENTS

| | | |
|---|---|---|
| 1208082 | 7/1986 | Canada . |
| 332690 | 7/1930 | United Kingdom . |
| 2108054A | 5/1983 | United Kingdom . |
| 2123353A | 2/1984 | United Kingdom . |
| 2135272A | 8/1984 | United Kingdom . |

OTHER PUBLICATIONS

Article entitled "Rig disasters–why not hang around for a while?", 4525 Ship & Boat International (1985) Oct., No. 8, London, Great Britain.

Conference paper entitled "An Offshore Evacuation System: A Safe Haven and an Emergency Control Centre" by B. Bengtsson and S. Thulin, presented at the 17th Annual Offshore Technology Conference in Houston, Texas, May 6–9, 1985.

*Primary Examiner*—Stephen P. Avila

*Attorney, Agent, or Firm*—Irvin A. Lavine

[57] ABSTRACT

A system for launching and retrieving boats from an offshore work platform, the system comprising a deployment arm adapted to be rotatably secured at one end thereof to superstructure of the platform for rotation between a first pre-launch position and a second post-launch position, means for controlling rotation of the arm between the first and second positions, and boat support means mounted adjacent an outer end of the arm, the support means comprising a spaced pair of support members each having thereon an open claw structure for receiving a support pin associated with a respective side of a boat.

27 Claims, 3 Drawing Sheets

EVACUATION SYSTEM

This application relates to evacuation systems for offshore work platforms, such as drilling and production platforms in the offshore petroleum industry.

BACKGROUND OF THE INVENTION

Offshore platforms for various uses, including ocean research, are in widespread use throughout the world. The majority of these platforms are found in the offshore petroleum industry in exploration and production functions.

The offshore drilling industry and the technology associated with it have developed rapidly in the last thirty years. The drilling rigs in use today have evolved into sophisticated structures, designed and built to withstand the severest of environmental conditions and to operate in very deep waters. Advanced computer technology has contributed substantially to bring platform development to its present position. Computers are integral, for example, to the collection and evaluation of geological and seismic data, to the operation of dynamically positioned platforms, and to methods of well control.

In spite of the advanced state of technology, accidents and storm effects requiring evacuation from drilling platforms still occur with alarming regularity. Such accidents may include, for example, fire on board. In addition to this type of accident, environmental conditions off certain coasts, such as off Eastern Canada, are especially severe with extremes of wind and wave, and a frequency of storms above that found in other areas. The "100 year storm" standard for this area is based on a wave height of 31 meters. Both accidents and weather conditions may necessitate evacuation of the platform. Such occurrences have in recent years lead to very substantial loss of life by virtue of the inadequacies of the evacuation systems.

Unfortunately, evacuation systems and the component parts of those systems have not kept pace with the rapid development of technology in the platform itself. There are currently, in particular, shortcomings in all three major components of evacuation. These components are the mustering and boarding procedure, the launch and the removal of the survival craft from the area of the platform. As a result, there is a critical need for a safe means of evacuation of a drilling platform in last resort situations. The present invention addresses the launch part of the evacuation.

PRIOR ART

A very large number of systems for evacuation of ocean-going vessels have been devised over a long period of years. These generally have been concerned with the specific manner of launch of lifeboats from ships and, more recently, from platforms.

U.S. Pat. No. 426,449, issued Apr. 29, 1980 to Hosford, illustrates a traditional boat and launch mechanism with a two-hook hanging float-off bar. The lifeboat has corresponding hooks or U-form bolts. Such systems have been rejected for modern platform evacuation, because of the uncertainty in the disengagement of the hooks.

U.S. Pat. No. 582,069, issued May 4, 1897 to Leslie, illustrates an early version of a system utilizing rotating davits which carry a cradle to support a lifeboat. The cradle is wheeled and moves on tracks on the davits to maintain trim as the davits are lowered. The davits simply submerge to allow the boat to float off of the cradle.

U.S. Pat. No. 2,091,327, issued Aug. 31, 1937 to McPartland, illustrates a somewhat later version of an escape system in which a pair of rotating davits move down to water level to release a lifeboat. The davits form a part of a rail system on a ship by which the boats are transferred to the davits. The boat floats from upturned ends of the davit rail when the davit is lowered. A locking device is provided for maintaining the davits in position when not in use.

U.S. Pat. No. 4,522,144, issued Jun. 11, 1985 to Klem, illustrates a free-fall system, the free-fall concept having become the subject of a considerable amount of research in recent years. The boat is held rigidly when not in use, since the angle of approach to the water when the boat is released is critical.

Canadian Patent 1,208,082, issued to the present inventor, O'Brien, Jul. 22, 1986, illustrates a system having general similarities to the present. It is of note that that system utilized a cradle to support the lifeboat.

U.K. published application No. 2,108,054, Auberty et al, published May 11, 1983, illustrates a semi-submersible lifeboat which is stored in a ship below the water line. The lifeboat is stored on a cradle, the cradle being ejected when a hatch is blown to allow a launch. The boat floats from or is forcibly ejected from the cradle and gradually reaches the surface as it moves away from the ship. The boat is provided with pins which rest in slots in the edge of the cradle.

U.K. published application No. 2,123,353, Bengtsson, published Feb. 1, 1984, illustrates another version of a free-fall lifeboat. The boat is hooked over a capsule on the end of a boom, and when the boom is lowered to a certain level, the capsule simply slides off the boom to free-fall to the water surface.

Finally, U.K. published application No. 2,135,272A, Garrad et al, published Aug. 30, 1984, provides a rotating davit which carries a double cradle from which lifeboats are launched. The application is written in very general terms and does not show how the unit might be usable with a single lifeboat as opposed to a pair.

SUMMARY OF THE INVENTION

Applicant has been researching and developing evacuation systems for offshore platforms for some ten years. In the course of that work a wide variety of refinements and concepts have been investigated with a view to meeting certain requirements of systems in actual use. These include factors such as the obvious need to maintain the system in top working order. This in turn requires that routine maintenance be able to be carried out at maximum efficiency but with minimum cost. As well, the psychological constraints which are imposed on personnel when a system must actually be used for evacuation in an emergency are so severe that the system must be absolutely as simple as possible, requiring a minimum of intervention and providing maximum reliability.

The system must be as light as possible in order to have minimum impact on the overall centre of gravity of the platform.

Finally, since practice drills are an inherent part of the overall safety scheme on a platform, the boat must be capable of being readily recaptured after a drill.

Reconciliation of these many factors, often conflicting, is the great difficulty in providing a usable system.

Addressing all of these factors, the invention provides a system for launching and retrieving boats from an offshore work platform, said system comprising a deployment arm adapted to be rotatably secured at one end thereof to superstructure of said platform for rotation between a first pro-launch position and a second post-launch position, means for controlling rotation of said arm between said first and second positions, and boat support means mounted adjacent an outer end of said arm, said support means comprising a spaced pair of support members each having thereon an open claw structure for receiving a support pin associated with a respective side of a boat.

In a further embodiment the system includes a boat having a support pin extending transversely from each side thereof, said pins being coaxial and extending beyond any parts of said each side of said boat, and said pins being adapted to be seated in said open claw structures.

BRIEF DESCRIPTION OF THE DRAWINGS

In drawings which illustrate embodiments of the invention.

Figure 2:
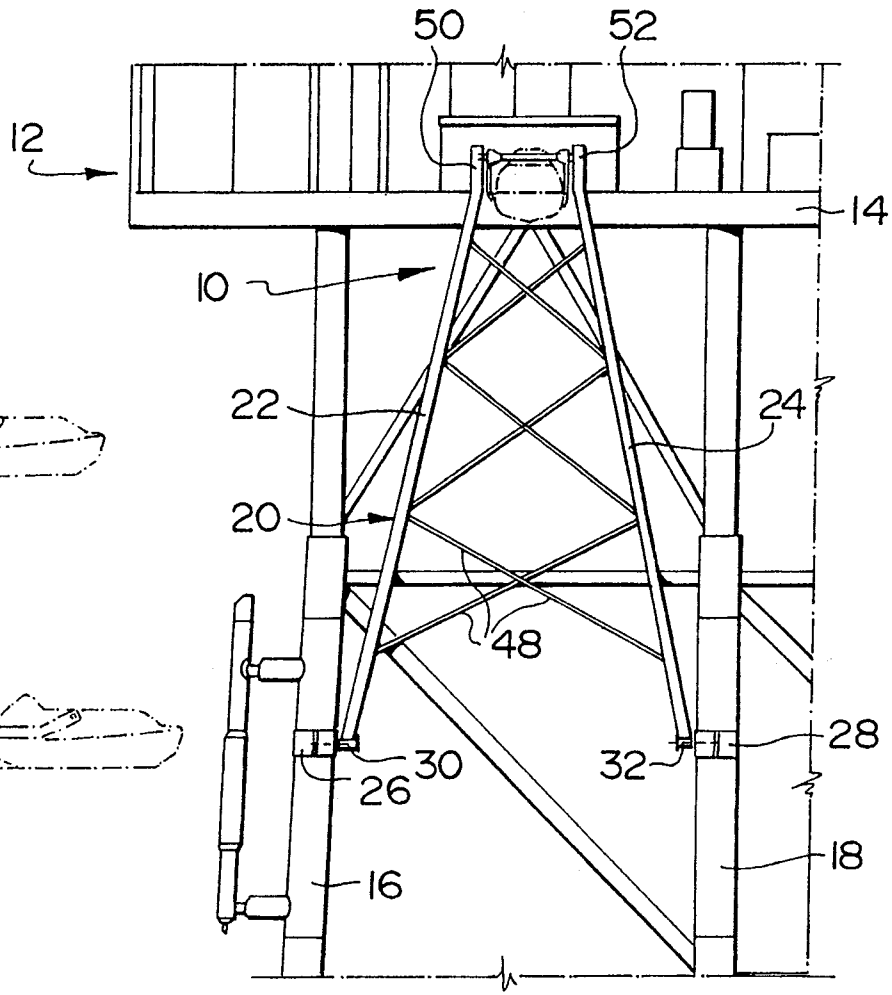
FIG. 2 is a front elevation of the system of FIG. 1.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

The evacuation system 10 is shown mounted on an offshore work platform 12.

The platform 12 comprises work levels including deck 14 which are supported in part by risers 16 and 18. The deployment arm 20 comprising elongate members 22 and 24 is rotatably secured to risers 16 and 18 by clamps 26 and 28 respectively.

Clamps 26 and 28 may be of a type known in the industry. The actual mechanisms of rotation 30 and 32 are mounted on clamps 26 and 28 respectively. The clamps are located preferably at or about the high astronomical tide level (HAT).

Figure 8:
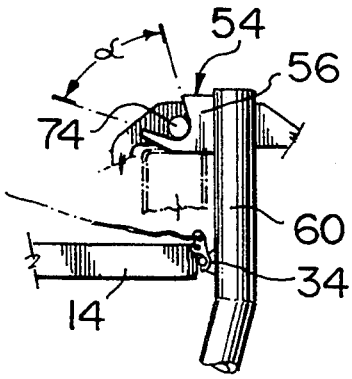
FIG. 8 is a partial side elevation of the structure of FIG. 5 illustrating the deployment arm in position.

In the preferred embodiment, as shown in FIG. 8, the deployment arm 20 is secured to the deck 14 by a locking means 34 which is releasable from within the boat 36.

The system comprises means 38 for controlling the raising and lowering of deployment arm 20. In the preferred case the means 38 comprises a winch 40 and cable 42. In one preferred case cable 42 is dead-headed at 44 on platform 12. The cable then extends from dead-head 44 through a shears 46 on deployment arm 20 to winch 40.

The winch per se does not form a part of the present invention. A suitable winch including an appropriate braking device may be used.

In the preferred embodiment, as noted, the deployment arm 20 comprises elongate members 22 and 24 which are secured together and suitably reinforced by a cross-bracing 48. In the preferred case elongate members 22 and 24 are tubular.

The elongate members 22 and 24 include integral support members 50 and 52 each of which carries thereon an open claw structure 54. Each said claw structure includes a base member 56 and open seat 58.

Figure 1:
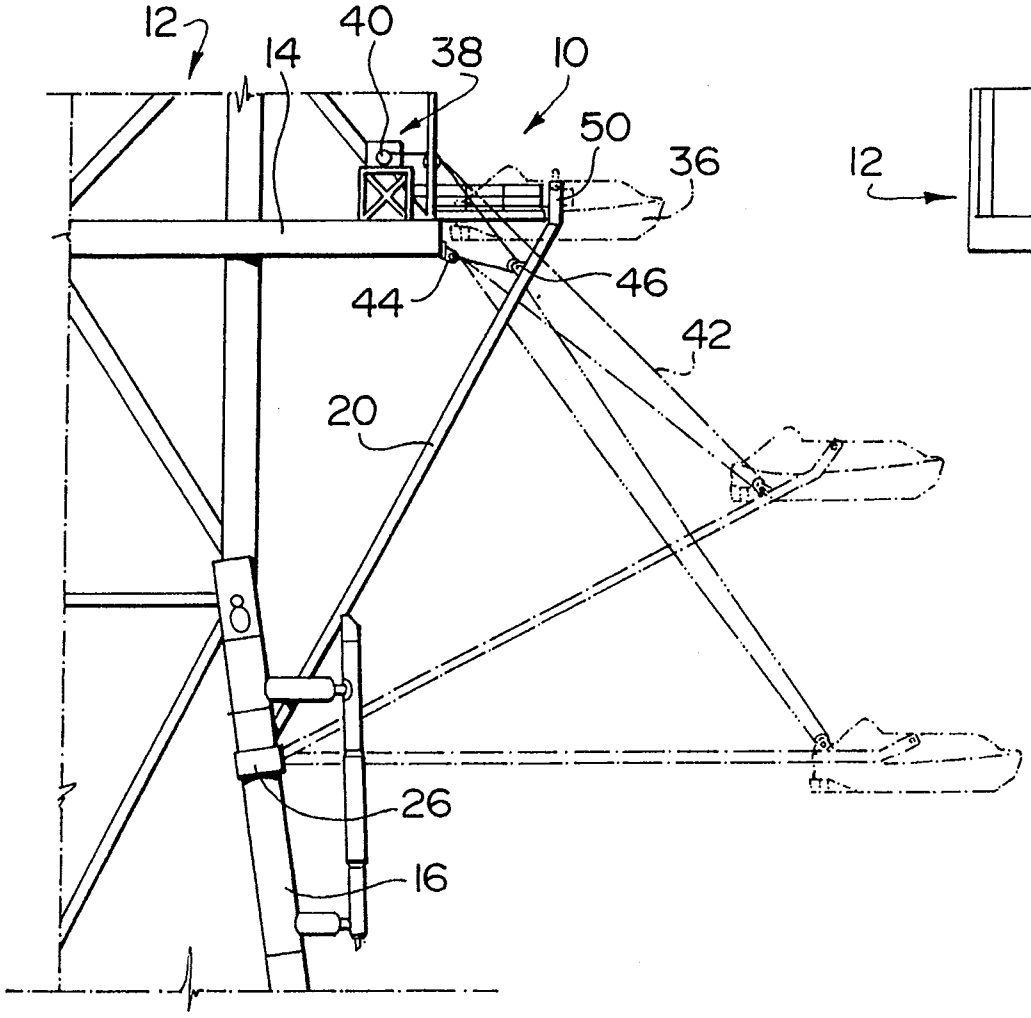
FIG. 1 is a side elevation of the system in place on a platform.
Figure 3:
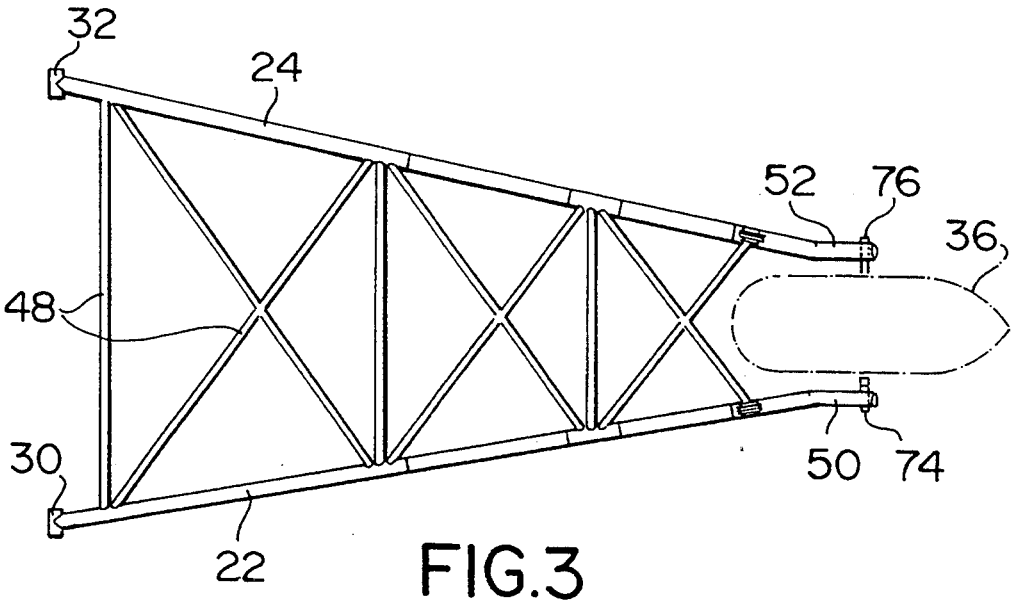
FIG. 3 is a top plan view of a deployment arm, partially deployed, for use in the system of FIG. 1.

The deployment arm 20 is rotatable between the pre-launch position illustrated in FIG. 1 and a post-launch position in which the outer part 60 of deployment arm 20 is submerged well below the surface of the water.

Figure 4:
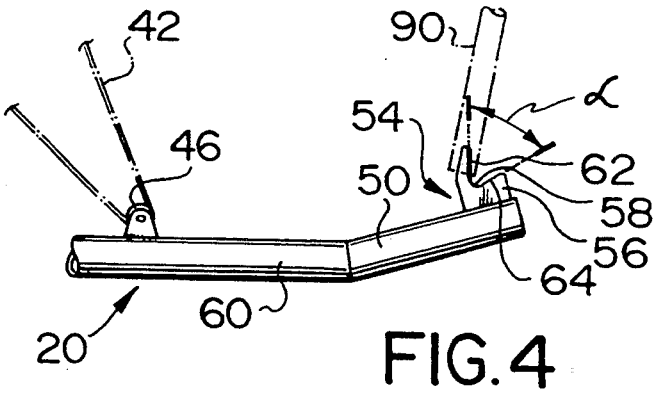
FIG. 4 is an end elevation in a deployed condition of a part of the deployment arm of FIG. 3.
Figure 5:
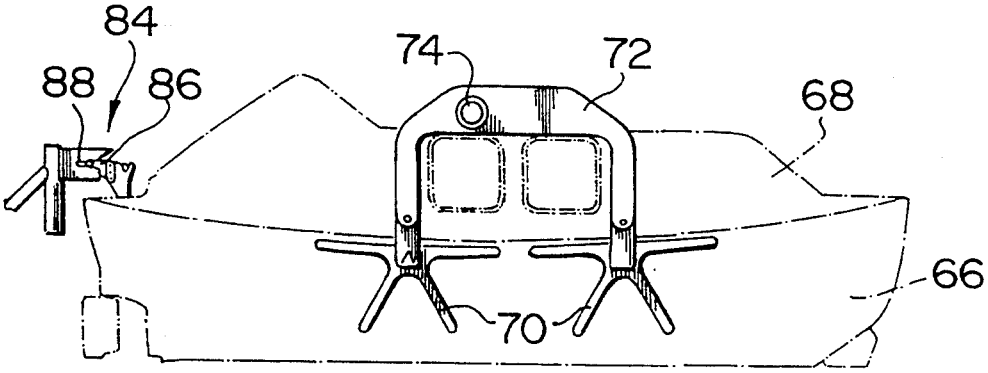
FIG. 5 is a side elevation of a boat and yoke for use in the system of FIG. 1.
Figure 6:
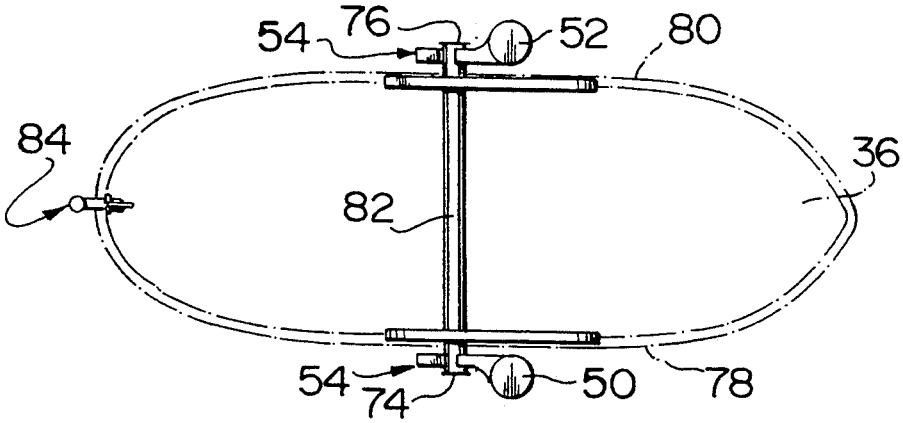
FIG. 6 is a top plan view of the structure of FIG. 5, illustrating the position of the end of the deployment arm.
Figure 7:
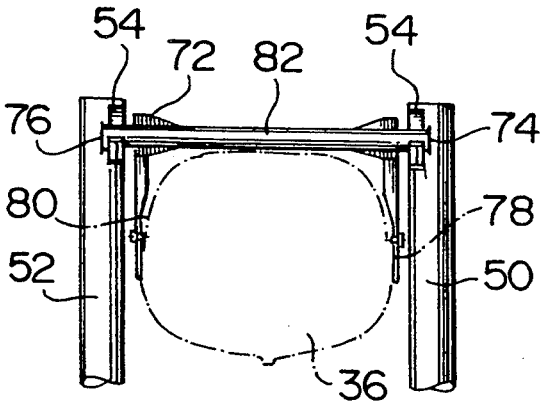
FIG. 7 is an end elevation of the structure of FIG. 5, illustrating the position of the end of the deployment arm.

The outer part 60 of arm 20 is illustrated in the pre-launch position in FIG. 8 and in an intermediate launch position in FIG. 4.

It will be noted that the open seat 58 in the pre-launch position of FIG. 8 opens upwardly and inwardly toward platform 12. The angle $\alpha$ subtended by the sides 62 and 64 of seat 58 is less than 90° and preferably about 70°.

In the launch position illustrated in FIG. 4 the open seat 58 opens in the outward and upward direction.

FIGS. 5 to 8 illustrate the positioning of a boat in the system. The illustrated embodiment is particularly useful for the retrofit of existing boats. Thus, the boat 36 will, as required by law, be totally enclosed and will comprise a hull part 66 and a canopy 68. Brackets 70 carrying yoke 72 may be secured to hull 66.

The yoke 72 includes pivot pins 74 and 76 which protrude laterally beyond the sides 78 and 80 of boat 36. In the preferred case the pins 74 and 76 are an integral part of a single elongated pin 82.

The axis of pin 82 lies directly above the centre of gravity of the boat 36.

The boat is supported in deployment arm 20 by seating the pins 74 and 76 in the open seats 58.

It will be noted that the angle $\alpha$ formed by the sides of the seats is such that the sides 62 and 64 of the seats, as illustrated in FIG. 8, hold the boat 36 securely in place in the pre-launched position illustrated in that figure; whereas in the launch position of FIG. 4, the pins 74 and 76 can freely float off of the seats 58 with no interference whatsoever by any surrounding structure.

In the actual launching procedure, the deployment arm 20 will be deployed at a rate in the order of 100 to 150 meters per minute, say, 120 meters per minute, or faster without undue effects on personnel. Thus, arm 20 will rapidly submerge and drop away from boat 36.

It will be understood that the position of the pins 74 and 76 can vary depending on centre of gravity and other considerations. For example, the pins 74 and 76 may extend from hard spots formed in the hull 66. As well, the yoke 72 may be formed integral with the hull 66 and/or the canopy 68, and the pins 74 and 76 may extend from any preferred position on the yoke.

In the preferred embodiment steadying means 84 is provided to maintain the trim of the boat 36 in the pre-launch position. Means 84 is preferably simply formed by a tongue 86 mounted from a hard point at the stern of boat 36 and a groove 88 mounted at an appropriate position on platform 12. Clearly, when a launch begins and arm 20 begins to rotate away from platform 12, the tongue 86 will simply slip out of groove 88 without intervention by platform personnel.

As the arm 20 rotates down to launch position, the boat 36 will rotate on pins 74 and 76 in seats 58, by virtue of the position of the centre of gravity of the boat, to maintain the trim of the boat during the launch procedure.

Because safety drills are required to be carried out on the platform, it is necessary that the arm 20 be capable of recapturing the boat 36 after a drill. To facilitate this process, the system preferably includes extensions 90 which are selectively positionable on sides 62 or 64 of open claw structure 54 to guide the pins 74 and 76 into seats 58.

Thus it is apparent that there has been provided in accordance with the invention an evacuation system that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claimed is:

1. A system for launching and retrieving from an offshore work platform a boat having support pins extending outwardly thereof, said system comprising:

a deployment arm adapted to be rotatably secured at one end thereof to superstructure of said platform for rotation between a first pre-launch position in which an outer end of said arm is above the surface of the water and a second post-launch position in which said outer end of said arm is substantially at or below the surface of the water;

means for controlling rotation of said arm between said first and second positions;

a pair of spaced support members mounted adjacent said outer end of said arm, each having thereon an open claw structure for receiving a support pin connected to and extending outwardly of a boat to be launched and retrieved, said claw structure opening generally upwardly when said deployment arm is in said first pre-launch position and opening upwardly and outwardly when said deployment arm has been rotated to a position in which the outer end thereof is at or near water level, said system being free of structure in addition to said deployment arm and support members for connecting said system with a boat.

2. The system of claim 1 wherein said arm comprises a pair of spaced elongate members joined by transverse bracing and wherein said spaced pair of support members comprise integral extensions of said spaced elongate members.

3. The system of claim 2 wherein said members are tubular.

4. The system of claim 2 wherein each of said pair of members is secured to a vertical part of said superstructure.

5. The system of claim 4 wherein said members are secured to said superstructure by clamps.

6. The system of claim 1 wherein each of said pair of members is secured to said superstructure at the high astronomical tide (HAT) level or higher.

7. The system of claim 1 wherein in said pre-launch position of said arm an outer end of said arm is adjacent a boat loading station, and in said post-launch position of said arm an outer end of said arm is below the surface of the water.

8. The system of claim 1 wherein said means for controlling rotation of said arm comprises a winch for mounting on said platform and a cable extending from said winch to said arm.

9. The system of claim 8 wherein said cable is dead-headed on said platform and to then extend through a sheave on said arm and hence to said winch.

10. The system of claim 9 wherein said cable is dead-headed at a level on said platform close to the level of said winch.

11. The system of claim 1 wherein said claw structure is upstanding relative to said support members when said members are at the surface of the water.

12. The system of claim 11 wherein each said claw structure comprises near the extremity thereof an open rounded seat for a pivot pin.

13. The system of claim 12, wherein each said seat opens upwardly and inwardly when said arm is in said pre-launch position.

14. The system of claim 13, wherein each said seat comprises sides which would, if extended into said seat, define an angle of less than 90°.

15. The system of claim 14 wherein said angle is about 70°.

16. A system for launching and retrieving boats from an offshore work platform, said system comprising:

a deployment arm adapted to be rotatably secured at one end thereof to superstructure of said platform for rotation between a first pre-launch position in which an outer end of said arm is above the surface of the water and a second post-launch position in which Said outer end of said arm is substantially at or below the surface of the water;

means for controlling rotation of said arm between said first and second positions;

a pair of spaced support members mounted adjacent said outer end of said arm, each having thereon an open claw structure for receiving a support pin connected to and extending outwardly of a boat; and a boat having a support pin extending transversely from each side thereof, said pins being coaxial and extending beyond any parts of said each side of said boat, and said pins being seated in said open claw structures in said pre-launch position of said deployment arm.

17. The system of claim 16 wherein said boat includes a yoke secured thereto, and said pins extend from said yoke.

18. The system of claim 17 wherein said yoke extends above said boat and said pins comprise the ends of a single elongated member.

19. The system of claim 17 wherein said pins are located above and on a line through the centre of gravity of said boat.

20. The system of claim 17 wherein said yoke is integral with said boat.

21. The system of claim 17 wherein said boat is totally enclosed and includes a hull and a canopy, and said yoke is integral with said hull and said canopy.

22. The system of claim 16, wherein said boat includes a rearwardly extending tongue member and wherein said system includes a grooved member on said platform, said tongue being within said groove when said deployment arm is in said pre-launch position, whereby vertical movement of the stern of said boat relative to said platform is prevented when said deployment arm is in said pre-launch position.

23. The system of claim 8, including, in addition, positive locking means between said arm and said platform for maintaining said arm in said pre-launch position without assistance from said winch or said cable when said arm is in said pre-launch position.

24. The system of claim 23, and further comprising means for releasing said locking means from within a boat supported on said deployment arm.

25. The system of claim 1 including, in addition, a selectively removable extension section for each said claw structure for guiding respective pins on a boat into said claw structure fox recapturing a boat from the water.

26. The system of claim 16, said system and said boat being free of structure in addition to said deployment arm and support members for connecting said system with said boat when said deployment arm has moved from said first pre-launch position.

27. The system of claim 16, and means for preventing vertical movement of the stern of said boat when said arm is in said pre-launch position.

* * * * *